US006746373B1

(12) United States Patent
Bohmer

(10) Patent No.: US 6,746,373 B1
(45) Date of Patent: Jun. 8, 2004

(54) HAND EXERCISE APPARATUS

(76) Inventor: John B. Bohmer, 6935 Pioneer Rd., West Palm Beach, FL (US) 33413

( * ) Notice: Subject to any disclaimer, the term of this patent is extended or adjusted under 35 U.S.C. 154(b) by 324 days.

(21) Appl. No.: 09/917,018

(22) Filed: Jul. 30, 2001

(51) Int. Cl.[7] ..... A63B 23/16
(52) U.S. Cl. ..... 482/44; 482/49; 482/128; 434/260
(58) Field of Search ..... 482/44–49, 114, 482/115, 127, 128, 148; 434/219, 260, 258, 401

(56) References Cited

U.S. PATENT DOCUMENTS 2,835,986 A * 5/1958 Roeder ..... 434/260
2,985,451 A * 5/1961 Sims ..... 273/446
3,276,149 A * 10/1966 Barnabas ..... 434/260
3,427,731 A * 2/1969 Debolt ..... 434/260
4,203,591 A * 5/1980 Gibson ..... 482/46
4,337,050 A * 6/1982 Engalitcheff, Jr. ..... 434/260
4,457,722 A * 7/1984 Housand ..... 434/260
4,795,351 A * 1/1989 Vermette ..... 434/258
5,403,190 A * 4/1995 Wickstrom ..... 434/260
5,431,611 A 7/1995 Silagy
5,514,052 A 5/1996 Charles
2002/0094913 A1 * 7/2002 Valentino ..... 482/45

OTHER PUBLICATIONS

Flaghouse Rehab, Spring 1995 catalog, various finger and hand exercise devices, pp. 23–25.*

* cited by examiner

*Primary Examiner*—Jerome W. Donnelly
*Assistant Examiner*—Victor K. Hwang
(74) *Attorney, Agent, or Firm*—Alvin S. Blum

(57) ABSTRACT

An exercise device is held in first one hand and then in the other hand, while the second hand is exercised by screwing nuts in on threaded rods against a spring resistance. Both right hand and left hand threads are provided so that exercise of clockwise and counterclockwise motions are required. The nuts have different outside diameters so that the gripping of the nuts will be at different positions to enhance the experience. Also provided are springs of different tensions to adjust the resistance to rotation.

6 Claims, 2 Drawing Sheets

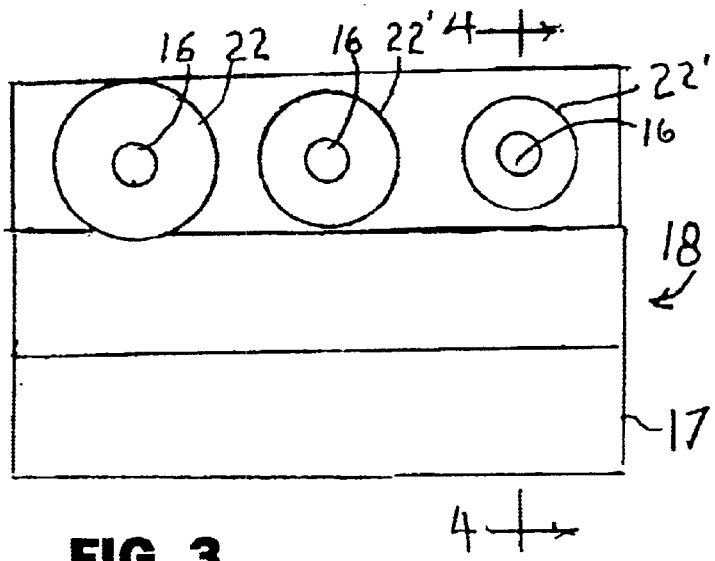
FIG. 3
FIG. 5
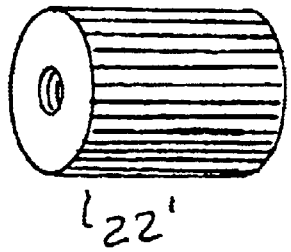
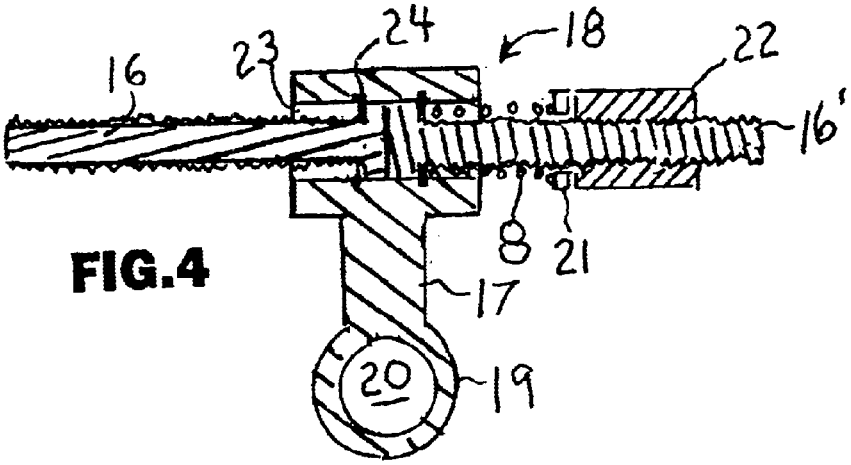
FIG.4
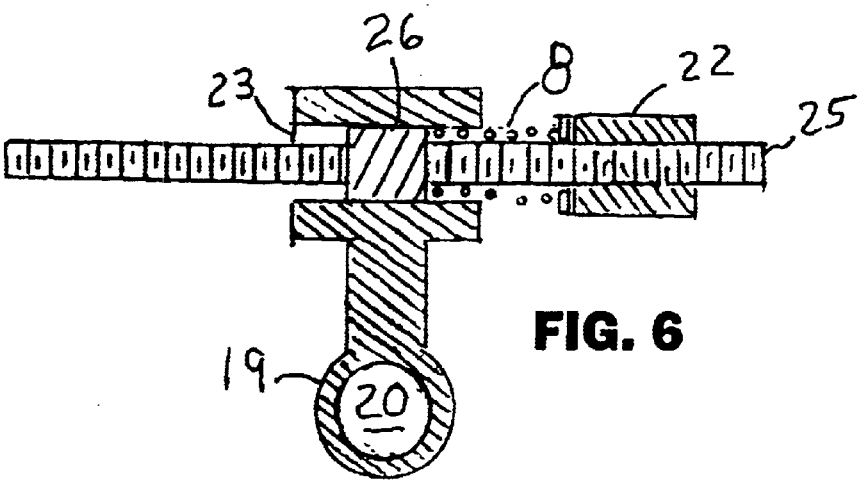
FIG. 6

HAND EXERCISE APPARATUS

This invention relates to exercise apparatus, and more particularly to apparatus for exercising the fingers, hand, and arm in rotary motion.

BACKGROUND OF THE INVENTION

Hand and finger exercising devices are well known in the art, as exemplified by U.S. Pat. No. 5,431,611 issued Jul. 11, 1995 to Silagy and U.S. Pat. No. 5,514,052 issued May 7, 1996 to Charles. These are generally designed to strengthen the grip of the hand by exercising the muscles that cause flexion or extension of the fingers by opening or closing the hand against resistance. Many people, such as mechanics, also use their hands in a rotary or twisting motion. The prior art devices do not exercise the hand using those motions.

SUMMARY OF THE INVENTION

It is accordingly an object of the invention to provide a means for exercising the fingers,thumbs, hand, and wrist by rotary or twisting motion against resistance. It is another object that the exercise motions be bidirectional. It is another object that the resistance be adjustable. It is yet another object that the device be small, portable, and inexpensive to manufacture.

These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 3 is a side view of another embodiment of the invention.

FIG. 4 a sectional view taken on line 4—4 of FIG. 3.

FIG. 5 is a perspective view of one of the knobs of FIG. 3.

FIG. 6 is a sectional view as in FIG. 4 of another embodiment of the invention.

DETAILED DESCRIPTION OF PREFERRED EMBODIMENTS

Figure 2:
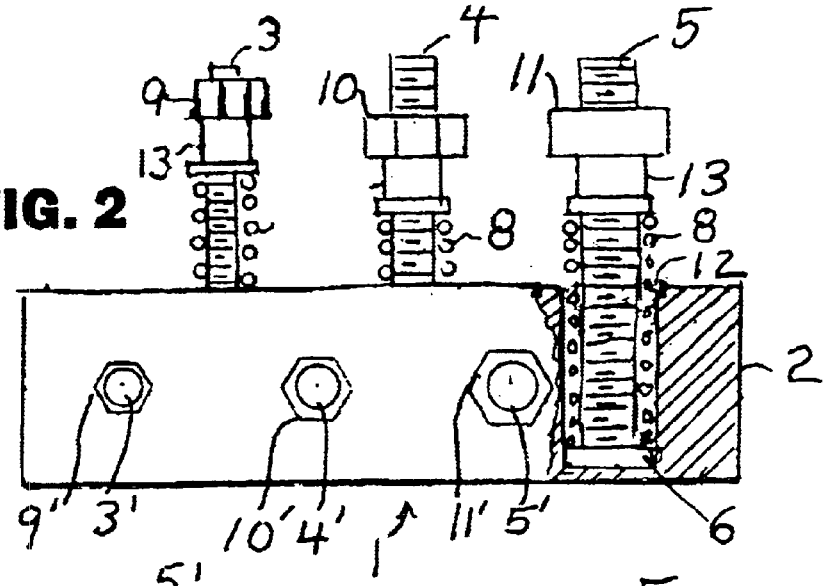
FIG. 2 is a side view, partially broken away,of the invention.
Figure 1:
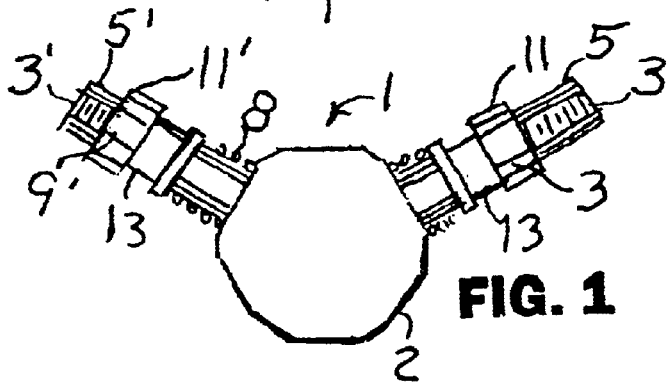
FIG. 1 is an end view of the invention.

Referring now to the drawing FIGS. 1 and 2, exercise apparatus 1 of the invention comprises a base 2, small and light enough to be held in one hand. Threaded rods 3, 4, 5, 3', 4', 5' each have a head end 6 affixed within the base at the bottom of a blind hole 12. The free end of each rod extends outwardly from the base. The threaded rods are stainless steel bolts with fine threads, 3,4,5 having right hand threads, and 3',4',5' having left hand threads. Rods 3 and 3' have a ¼ inch diameter. Rods 4 and 4' have a 5/16 inch diameter. Rods 5 and 5' have a ⅜ inch diameter. Encircling each rod is a helical compression spring 8 small enough in diameter to fit into the hole 12. A lubricated bronze bushing 13 is forced against the spring when a threaded nut is screwed down onto it. Compression of the spring provides resistance to nut rotation. The bushings 13 keep the fingers away from the base and avoid the nuts catching on the springs. The nuts are provided with corresponding internal threads of corresponding diameters to engage the rods. The nuts 9, 10, 11, 9', 10', and 11', have outside diameters from small to large, as shown. They may be coated with a resilient or slip resistant material. This provides the user with a range of positions of the thumb and fingers as the nuts are screwed in. Half of the motions will be clockwise, and half counterclockwise rotation, because half the rods have left hand threads and half have right hand threads. The device is held in a first hand and the nuts are turned with the second hand. The device is then held with the second hand and the nuts turned with the first hand. The device is then turned end for end, and the process repeated. This exercises the muscles of fingers, thumbs, hands, and wrists at three diameter positions in both directions of rotation. To add further variety and adjustment to the exercise device, it is provided with three complete sets of springs, each set having a different resistance to compression. The springs may be helical wire, or resilient plastic, or other spring means well known in the art.

Figure 7:
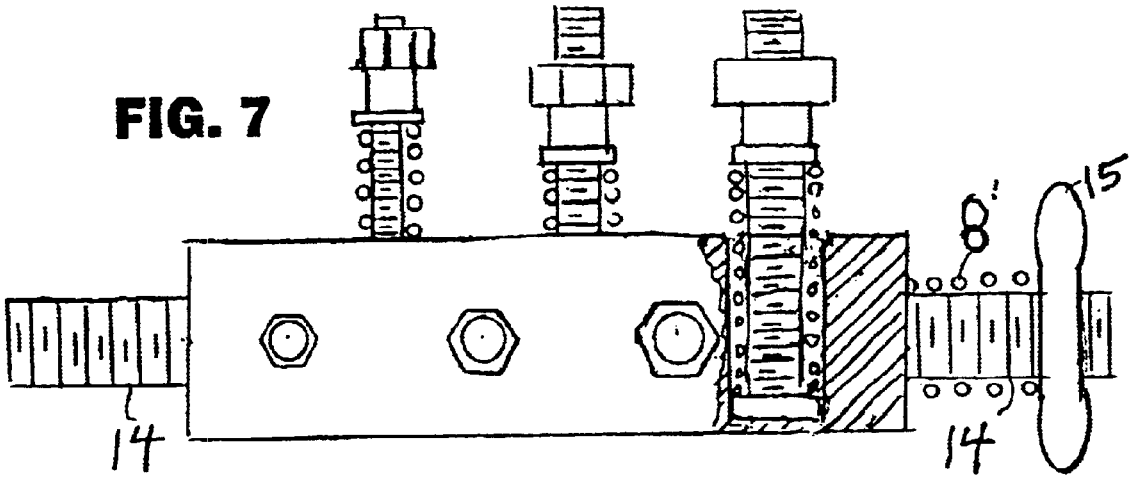
FIG. 7 is a side view of another embodiment of the invention.

Referring now to FIG. 7, the base may also be provided with large diameter threaded rods 14 with wing nuts 15 for different angle and gripping exercise.

Referring now to FIGS. 3–5, another embodiment 18 of the invention is shown. The base 17 is adapted with an enlargement 19 to enhance gripping. A chamber 20 is a storage space for the extra springs. The 3 threaded rods 16 that have a right hand thread and the 3 threaded rods 16' that have a left hand thread are all of the same ¼ diameter. The heads of opposing rods 16, 16' are fixed within a common through hole 23 in the base by spring rings 24. The nuts 22, 22', and 22" are long enough that the bushings are not required, and they are serrated for enhanced gripping. They are provided in three diameters to give the different finger gripping positions. Simple nylon washers 21 provide smooth operation.

Referring now to FIG. 6, an embodiment similar to that of FIG. 4 is shown. In this case, the threaded rod 25 is a single rod with opposite ends threaded, one end with a left hand thread, and the other end with a right hand thread. The mid portion 26 is enlarged, and is fixed within the bore 23 by first heating the aluminum base and then forcing the steel rod in place. Threads on the rods may be fine or coarse as desired.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A handheld apparatus for the fingers, thumbs, hands, and wrists of a person, the apparatus comprising:

a) a base;

b) a plurality of threaded rods, each rod having a first end affixed to the base and a second end extending outwardly from the base;

c) a spring encircling each rod;

d) a plurality of nuts, with a nut threadedly mounted on each rod and engaging the spring, such that rotation of the nut in a first direction compresses the spring, and rotation in a second direction reduces compression of the spring;

e) the plurality of rods extending from the base in at least two directions including at least two rods with a right hand thread and at least two rods with a left hand thread; and f) the plurality of nuts including at least two nuts with a first outer diameter and at least two nuts with a second outer diameter, and in which the second outer diameter is greater than the first outer diameter.

2. The apparatus according to claim 1, in which the plurality of threaded rods comprises three rods of increasing thread diameter having a right hand thread and three rods of increasing diameter having a left hand thread, and the plurality of nuts includes two nuts of a first outer diameter, two nuts of a second outer diameter, and two nuts of a third outer diameter.

3. The apparatus according to claim 2, further comprising a plurality of springs of different compressive strength for application to the rods to change rotation resistance.

4. The apparatus according to claim 1, in which the plurality of threaded rods comprises three rod having a right hand thread and three rods having a left hand thread, all of the rods having the same thread diameter, and the plurality of nuts includes two nuts of a first outer diameter, two nuts of a second outer diameter, and two nuts of a third outer diameter.

5. The apparatus according to claim 4, further comprising a plurality of springs of different compressive strength for application to the rods to change rotation resistance.

6. The apparatus according to claim 1, further comprising a plurality of springs of different compressive strength for application to the rods to change rotation resistance.

* * * * *